US007269901B2

(12) United States Patent
Robin

(10) Patent No.: US 7,269,901 B2
(45) Date of Patent: Sep. 18, 2007

(54) METHOD OF MANUFACTURING A FRAME

(76) Inventor: Aurele Robin, 129 Massena Crescent, Winnipeg, Manitoba (CA) R2P 0K8

( * ) Notice: Subject to any disclaimer, the term of this patent is extended or adjusted under 35 U.S.C. 154(b) by 238 days.

(21) Appl. No.: 10/947,276

(22) Filed: Sep. 23, 2004

(65) Prior Publication Data

US 2006/0059687 A1 Mar. 23, 2006

(51) Int. Cl.
*B21D 47/00* (2006.01)

(52) U.S. Cl. ..... 29/897.31; 29/464; 29/559; 29/281.1; 29/281.5; 269/37; 269/289 R; 269/291; 269/905; 269/909

(58) Field of Classification Search ..... 29/897.31, 29/464, 466, 468, 559, 565, 52, 54, 281.1, 29/281.3, 281.4, 281.5; 269/37, 58, 91, 134, 269/156, 289 R, 290, 291, 297, 298, 299, 269/304, 309, 905, 909, 910
See application file for complete search history.

(56) References Cited

U.S. PATENT DOCUMENTS 4,332,366 A * 6/1982 Descals Munt ..... 248/670
4,481,701 A 11/1984 Hewitt
5,570,548 A 11/1996 Hopper
5,617,622 A * 4/1997 Anderson ..... 29/281.3
6,006,408 A 12/1999 Rogat
6,076,314 A 6/2000 Simonton et al.
6,231,036 B1 * 5/2001 Johnson et al. ..... 269/56
6,354,581 B1 * 3/2002 Johnson et al. ..... 269/229
6,401,428 B1 6/2002 Glover et al.
6,519,825 B1 * 2/2003 Lambert et al. ..... 29/281.1
2002/0060386 A1 * 5/2002 Konieczny ..... 269/56

FOREIGN PATENT DOCUMENTS

CA 1105323 7/1981
CA 2187826 6/2003
DE 4210675 A1 * 10/1993

* cited by examiner

*Primary Examiner*—Jermie E. Cozart
(74) *Attorney, Agent, or Firm*—Ryan W. Dupuis; Michael R. Williams; Adrian D. Battison

(57) ABSTRACT

An apparatus and methods of use thereof are provided for improved manufacturing of window and door frames. In particular, the present invention provides an apparatus that can improve efficiency and reduce manpower in manufacturing of window and door frames by being able to accommodate whole assembled window or door frames without manual assistance and by incorporating and utilizing multiple machining tools for machining of multiple surfaces of window and door frames. Correspondingly, the use of the apparatus of the present invention permits the practical use of an unconventional process for manufacturing window and door frames that can reduce wastage of materials.

20 Claims, 10 Drawing Sheets

METHOD OF MANUFACTURING A FRAME

FIELD OF THE INVENTION

This invention relates to the manufacture of window and door frames and, in particular, to an improved apparatus and an improved process for manufacturing window and door frames.

BACKGROUND

Traditionally, window or door frames made of plastic or metal are manufactured using a series of individual steps involving different workers with different skills sets and using different equipment performing different functions.

A conventional rectangular window or door frame is made of four lengths of elongated frame members joined to each other at the ends to form the rails and stiles of the rectangular window or door frame. For example, the four lengths of elongated frame members of desired dimensions are derived and cut from an original long strip of material as described in U.S. Pat. No. 4,481,701, which are then machined prior to assembly. Machining of each elongated frame member is usually performed on a single work station and conventionally involves the mitering of symmetrical forty-five degree bevel angles at each end of each length as well as the routing and drilling of various holes and slots along the lengths at predetermined positions to accommodate the later incorporation of various hardware items such as latches, locks, roto-gears, hinges and mullions. Subsequently, the four elongated frame members are transferred to a separate work station to be joined to each other at the forty-five degree bevel angles to form a four-corner rectangular window or door frame. Two commonly used methods for joining the corners include the use of various connecting means, corner keys or welding such as those described in Canadian Patent No. 1,105,323, Canadian Patent No. 2,187,826, U.S. Pat. Nos. 6,401,428, 4,481,701, 5,570,548 and 6,076,314. Once the four elongated frame members are joined together, the corner joints, such as the welding beads along the weld seams, then require to be stripped and/or cleaned using a seam cleaner such as the one described in U.S. Pat. No. 6,006,408.

One set of commonly encountered problems contributing to inefficiencies and material wastage of the aforementioned manufacturing setup and process is ascribable to the welding and weld cleaning steps. Accidental miswelds, breakages, chips and scratches to any corner of the window or door frame during these steps invariable result in scrapping of the majority of or the whole frame due to the holes and slots already machined throughout each elongated frame member from the preceding step at positions predetermined for the initially intended frame type and dimensions (which often time are not compatible with or suitable for a smaller re-cornered frame). One objective of the present invention is to minimize such inefficiency and wastage, which can be achieved by first performing the corner welding and weld cleaning steps prior to the machining steps, rather than the standard practice of first machining the individual unassembled lengths of the frame and then performing the welding and weld-cleaning steps.

In order to successfully implement this reversal of standard practice, a correspondingly designed apparatus is required to accommodate and handle whole, assembled, window or door frames, rather than just individual unassembled lengths of the frame. Conventional single person work stations cannot easily handle ready-joined frames and requires frequent repositioning of each whole frame to accommodate the relatively inflexible positioning and reach of the machine heads and tools of these single person work stations.

Existing apparati in general that can accommodate and handle whole, assembled, window or door frames have been encountered in the prior art, but they are relatively cumbersome, complex, and have relatively limited functionalities. For example, U.S. Pat. No. 5,100,270 teaches an apparatus for cutting mat board which includes only overhead machining tools for processing the top surface of the mat board when same is lying flat on the platform of the apparatus. Similarly, U.S. Pat. No. 6,390,900 teaches a tool mountable on a high speed spindle of a CNC machine tool, operable to finish only the side edge of a flat work piece positioned directly on a support surface of the machine tool.

With respect to prior art apparati that are capable of machining more than one surface of a work piece, U.S. Pat. No. 5,592,793 teaches a router machine with overhead and underside machining tools for making cuts at predetermined overhead and underside positions on a work piece. If this machine is used for the present purpose of machining a whole, assembled, window or door frame, it would be capable of machining one side member of the window or door frame member at a time, albeit on both top and bottom surfaces, and the whole, assembled, window or door frame would need to be manually rotated, relocated or otherwise repositioned before another side member of the window or door frame can be machined. Furthermore, the machining tools of said machine would only be aligned perpendicularly in relation to the surface of the window or door frame hence this machine would not be capable of machining the inner or outer edge surface of any window or door frame member. Similarly U.S. Pat. No. 5,379,510 also teaches a computerized numerically controlled drilling and milling machine with a bipartite worktable, again with overhead and underside machining tools, for machining overhead and underside positions on a work piece. Although this machine perceivably has better flexibility in terms of positioning of the machining tools as compared to the machine described in U.S. Pat. No. 5,592,793, its overhead and underside machining tools are again only aligned perpendicularly relative to the top and bottom surfaces of the work piece lying on its bipartite worktable and this machine again would not be able to directly machine any side edges of the work piece. U.S. Pat. No. 6,006,408 teaches a vinyl weld seam cleaner which essentially can be viewed as a combination of two machines per U.S. Pat. No. 5,592,793 placed opposite to each other. Although the alignment of the machining tools in relation to the work piece is rendered more flexible in this machine, the range of motion and the reach of each such machining tool remains to be restricted. For instance, since the machining tools are relatively restricted to two sides of the machine, only two opposite members of a square or rectangular window or door frame can be machined at a given time. When the other two opposite members of the square or rectangular window or door frame need to be machined, the window or door frame would need to be rotated ninety degrees so to place the members requiring machining within proximity of the machining tools.

SUMMARY OF THE INVENTION

According to a first aspect of the present invention there is provided an apparatus for machining a frame belonging to either a window or a door and being formed of elongated frame members joined to each other about a perimeter of the frame to define a front frame surface including a portion of each frame member, a back frame surface including a portion of each frame member, outer edge surfaces spanning between the front and back frame surfaces and facing away from one another and inner edge surfaces confronting one another, said apparatus comprising:

support means including at least one pair of parallel elongate work supports supported for movement relative to one another to adjust a spacing therebetween, each work support including a clamping surface parallel to and confronting the opposing clamping surface for clamping against at least a portion of the outer edge surfaces of the frame;

a machining device for supporting an interchangeable tool head therein; and an overhead mechanism supporting the machining device thereon for movement longitudinally substantially a full length of the frame and laterally substantially a full width of the frame;

whereby the machining device is capable of machining any one of the front frame surface, the inner edge surfaces, or the outer edge surfaces.

According to a second aspect of the present invention there is provided a method of manufacturing a frame for either a door or a window, said method comprising:

providing a plurality of elongated frame members;

joining the elongated frame members to each other to form a perimeter of the frame;

providing at least one pair of parallel elongate work supports supported for movement relative to one another to adjust a spacing therebetween, each work support including a clamping surface parallel to and confronting the opposing clamping surface;

clamping the clamping surfaces against at least a portion of the outer edge surfaces of opposing ones of the elongated frame members forming the frame;

providing an overhead mechanism supporting a machining device thereon which supports an interchangeable tool head therein;

machining a front frame surface, an inner edge surface, or an outer edge surface of the frame members forming the frame by moving the tool head longitudinally substantially a full length of the frame and laterally substantially a full width of the frame subsequently to joining the frame members.

By using the apparatus of the present invention, the machining steps required in window or door frame manufacturing may now be performed in an efficient and comprehensive manner after the corner welding and weld cleaning steps. In addition, the apparatus of the present invention may be automated via computer control thereby further reducing costs of manufacture and human error associated with conventional practices.

The work supports may include respective supporting surfaces lying in a generally common plane with one another for supporting the back frame surface thereon, wherein the clamping surfaces lie perpendicularly to the respective supporting surfaces.

The supporting surfaces of the work supports are preferably substantially narrower than the back frame surface of the frame members of the frame and the clamping surfaces are preferably substantially narrower than the outer edge surfaces of the frame. Each may have a width of approximately one inch.

One of the work supports preferably remains fixed while the opposing work support is movable towards and away from the fixed work support.

When two pairs of work supports are supported in a rectangular configuration, each work support is preferably abutted in sliding relationship along an adjacent one of the work supports. In this configuration one of the work supports may be fixed, two of the work supports may be slidable in one direction and a remaining one of the work supports may be slidable in two directions.

One pair of work supports are preferably supported for pivotal movement away from one another into a released position.

There may be provided a conveyor supported parallel to one pair of work supports for supporting a window frame thereon for sliding movement in relation to the work supports.

There may be provided a clamping member supported on each work support for clamping against an inner edge surface of the window frame to urge each frame member of the window frame against the respective clamping surface. The clamping member is preferably supported for movement along the respective work support.

By using the apparatus according to the present invention, all required machining operations on the frame, including front and back surfaces, may be accomplished with the frame supported in one position on the work supports.

The apparatus of the present invention can accommodate, and can efficiently machine, whole assembled window or door frames of varying shapes and sizes, including any structures cross linking the window or door frame members such as mullions. In one embodiment this is accomplished by having multiple machining tools that can independently and simultaneously machine all sides, surfaces and positions of any window or door frame, without the need to manually relocate, rotate or otherwise reposition the window or door frame between machining of different surfaces of a window or door frame member or between machining of different window or door frame members. Unlike the apparati of the prior art, the apparatus of the present invention is capable of performing multi-directional machining functions on all surfaces of each window or door frame member, independently or simultaneously, without the need to manually relocate, rotate or otherwise reposition the window or door frame between machining of different surfaces of a window or door frame member or between machining of different window or door frame members. For the present purpose, the X-direction represents a direction substantially parallel to the width of the apparatus, the Y-direction represents a direction substantially parallel to the length of the apparatus, and the Z-direction represents a direction substantially perpendicular to the width and length of the apparatus. The term "multi-directional" means more than one direction, whether X, Y or Z, and the term "XYZ-directional" means all three, X, Y and Z directions, or being capable of all three directions.

An unconventional method of manufacturing window and door frames is accordingly provided by the apparatus of the present invention. In particular, elongated frame members of appropriate dimensions are first fabricated and joined to each other to define the perimeter of the window frame using conventional means. Any and all structures designed to crosslink any frame members, such as mullions, may also be joined to the respective frame members at this stage. Subsequently, the whole, assembled, window or door frame comprising the above may then be machined using the apparatus of the present invention. Machining, for the present purpose herein, means the preparation of ornamental or structural requirements in or on the window or door frame members, which includes without limitation: (i) drilling of holes for drainage, mullion and hinge locations, and other hardware applications; (ii) routing of slots for locks, latches, roto-gears, and other hardware applications; (iii) applying screws or other attachment means to install hardware such as hinges onto the window or door frame; and (iv) drilling or routing of ornamental designs onto and sanding of the window or door frame members.

According to another aspect of the present invention, there is provided an apparatus for machining a frame belonging to either a window or a door and being formed of elongated frame members joined to each other about a perimeter of the frame, each elongated frame member having a front frame surface, a back frame surface, an inner edge surface, and an outer edge surface, said apparatus comprising:

support means including a generally planar support surface spanning longitudinally between respective ends and spanning laterally between respective sides of the support means to define a perimeter of sufficient size for substantially coplanar support of the back frame surface of the frame members on the support surface;

holding means to securely position the frame on the support surface;

at least one overhead machining tool capable of multi-directional machining of the front frame surface, the inner edge surface, or the outer edge surface of each frame member forming the frame, each overhead machining tool being pivotally attached to XY directional slide means to enable positioning of said overhead machining tool along both lateral and longitudinal directions parallel to the support surface to any point substantially within an overhead area defined by the perimeter of the frame; and at least one side machining tool disposed along the perimeter of the platform capable of multi-directional machining of the inner or outer edge surfaces of the frame members, said side machining tool head being attached pivotally to XY directional slide means supporting movement of said side machining tool in both the lateral and longitudinal directions along the perimeter of the frame.

According to another aspect of the present invention, there is provided an apparatus for machining a frame belonging to either a window or a door and being formed of elongated frame members joined to each other about a perimeter of the frame, each elongated frame member having a front frame surface, a back frame surface, an inner edge surface, and an outer edge surface, said apparatus comprising:

support means including a generally planar support surface spanning longitudinally between respective ends and spanning laterally between respective sides of the support means to define a perimeter of sufficient size for substantially coplanar support of the back frame surface of the frame members on the support surface;

holding means to securely position the frame on the platform;

at least one overhead machining tool capable of multi-directional machining of the front frame surface, the inner edge surface, or the outer edge surface of each frame member forming the frame, each overhead machining tool being pivotally attached to XY directional slide means to enable positioning of said overhead machining tool along both lateral and longitudinal directions parallel to the support surface to any point substantially within an overhead area defined by the perimeter of the frame; and at least one underside machining tool capable of multi-directional machining of the back frame surface of each frame member, said underside machining tool being attached pivotally to XY directional slide means to enable positioning of said underside machining tool in both the lateral and the longitudinal directions to any point substantially within an underside area defined by the perimeter of the frame.

In one embodiment, an apparatus of the present invention comprises an overhead XYZ-directional machining tool is capable of XYZ-directional machining the front frame surface, the inner edge surface, or the outer edge surface, of each window or door frame member. When more than one overhead machining tool is used, such overhead machining tools would correspondingly be capable of multi-directional machining the front frame surface and an edge surface of each window or door frame member. Similarly, an apparatus of the present invention comprising an XYZ-directional underside machining tool is capable of XYZ-directional machining the back frame surface, the inner edge surface, or the outer edge surface, of each window or door frame member. When more than one underside machining tool is used, such underside machining tools would correspondingly be capable of multi-directional machining the back frame surface and an edge surface of each window or door frame member.

The machining tools of the apparatus of the present invention are individually and independently conventional tools for drilling, boring, cutting, slotting, grinding, milling, smoothing, decorating, or affixing hardware onto, the window or door frame members. Preferably, the tools are rotary tools made of high-speed carbide-tipped steel or solid carbide and driven by conventional geared or gearless motor means such as a router, a drill, a circular blade, a rotary saw, a rotary hammer, a rotary grinder and a rotary sander or buffer. For example, typical types of machining requirements of a window or door in terms of hardware application may include, without limitation, drilling of holes for drainage and for fitment of mullions and hinges, routing of slots to accommodate locks and latches as well as mechanisms such as roto-gear or other like devices for opening and closing of the window or door, and potentially slotting of grooves to accommodate window panes.

The multi-directional movements and positioning of the tools of the apparatus of the present invention may be actuated and guided by conventional motor and track means, and preferably, such actuation and such guidance are controlled by computer with software adapted to cover a variety of window and door types. In order to maximize the efficiency of the apparatus of the present invention, the one or more overhead machining tool(s) and the one or more side machining tool(s) of said apparatus are capable of independently and simultaneously performing multi-directional machining of the window or door frame members. This ability of the apparatus of the present invention to perform simultaneous machining of more than one surface of the window or door frame, in any of the X, Y or Z directions, at any position within the general confines of the perimeter of the whole assembled window or door frame is in distinct contrast to the prior art apparati in that the latter apparati were only capable of performing simultaneous machining of multiple surfaces when the machining tool is relatively restricted within the close vicinity of one frame member of the window or door frame, thereby necessitating the manual rotation of the window or door frame when an adjacent frame member is to be machined, or when the machining tool is only capable of performing Z-directional or unidirectional machining tasks.

The elongated frame members of the window or door frame are made of a material that has sufficient structural integrity and thermal and sound insulative properties, as well as an acceptable thermal expansion coefficient compatible with the other components and hardware of the window or door.

In the present embodiment, the material of the window or door frame may be a plastic, preferably poly vinyl chloride (PVC), and the window or door frame can be substantially rectangular in format having four elongated frame members. Alternatively, the elongated frame members of the window or door frame may be made of a metal or an alloy, preferably aluminum or an aluminum alloy.

Prior to machining, the window or door frame is placed substantially flat on the platform of the apparatus of the present invention with the back frame surface of the window or door frame members being substantially coplanar with the apparatus platform. The window or door frame is then adjusted into correct position in relation to the machining tools and secured onto the platform by means of two or more slidable holding means protruding from the surface of the platform. Additional securement means such as conventional vacuum means may also be used in conjunction to further secure the window or door frame in position on the platform.

When machining a plastic window or door frame, an important aspect to consider is the potential of cut chips of plastics to "re-weld" to adjacent surfaces, especially when softer plastics are used. Correspondingly, the computer algorithms used to control the machining tools should be programmed in a manner so to maintain constant movement and sufficient feed rate of the machining tools and to minimize or eliminate periods when the tool is stationary during direction changes.

When the overhead machining tool is supported on an overhead mechanism, a work handling tool may be included which is operable in place of said overhead machining tool for loading and unloading a frame from the support surface.

The holding means preferably comprises at least one fixed clamping member which is fixed in relation to the support surface and at least one movable clamping member which is slidable parallel to the support surface relative to said at least one fixed clamping member.

The side machining tool is preferably also capable of multi-directional machining of the back frame surfaces of the frame members.

The underside machining tool is preferably also capable of multi-directional machining of the inner or outer edge surfaces of the frame members.

The support surface may include a plurality of openings formed therein for receiving said machining tools and said holding means therethrough.

The support surface may be formed of modular sections which are selectively separable from one another for accommodating various frame sizes and configurations.

The machining tools may be controlled by a computer controller which includes an electronic visual recording device capable of reading coded material imprinted on the frame which dictates machining operations to be performed by the machining tools.

According to a further aspect of the present invention there is provided a method of manufacturing a frame for either a door or a window, said method comprising:

providing elongated frame members of appropriate dimensions, each having a front frame surface, a back frame surface, an inner edge surface and an outer edge surface;

joining the elongated frame members to each other to form a perimeter of the frame;

providing a machining apparatus including a supporting surface and at least one machining tool movable across the support surface in two directions parallel to the support surface;

supporting the back frame surface of the frame members on the supporting surface; and machining the front frame surface, the inner edge surface and the outer edge surface of the elongated frame members of the frame using the machining apparatus subsequently to joining the frame members.

In one embodiment, the elongated frame members of the window or door frame are made of a material that has sufficient structural integrity and thermal and sound insulative properties, as well as an acceptable thermal expansion coefficient compatible with the other components and hardware of the window or door. In the present embodiment, the material of the window or door frame may be a plastic, preferably poly vinyl chloride (PVC). Alternatively, the elongated frame members of the window or door frame may be made of a metal or an alloy, preferably aluminum or an aluminum alloy.

If the desired window or door frame is rectangular in format, then four elongated frame members would be required. The four elongated frame members may be sourced by cutting a single length of prefabricated material with an appropriate cross section into appropriate lengths. The ends of each length may then be mitered with symmetrical forty-five degree angles and the lengths are welded together by conventional welding means useful for the type of material and configuration used to define a rectangular window or door frame. At this stage, any structures crosslinking the window or door frame members such as mullions may also be welded, for example by T-welding, onto the designated positions of the appropriate frame members. It should be readily apparent to persons skilled in the art that different joint configurations and corresponding joining methods are available and any such minor feature variations in methodology as to how the window or door frame members are assembled together should not detract function or utility of the present invention.

If any frame member of the assembled whole window or door frame is damaged or otherwise rendered useless for this instant application by any of the preceding steps, the damaged or useless portion or section may be deleted and the remaining length(s) of the frame member may be used for a window or door frame of smaller dimensions. This salvage opportunity resulting from the improved process of the present invention is in stark contrast to the prior art in that if the machining steps are performed on the individual frame members before the welding or otherwise assembly of said frame members into the window or door frame, the likelihood of reuse of any damaged frame member would be substantially less due to the ready existence of machined holes and slots at select locations on the frame members that are specifically suited to the dimensions of this window or door frame.

If the assembled whole window or door frame is satisfactory without damage or other defect from the preceding steps, it can then be placed substantially flat on the platform of the apparatus of the present invention with the back frame surface of the window or door frame members being substantially coplanar with the apparatus platform. The window or door frame is then adjusted into correct position in relation to the machining tools and secured onto the platform by means of two or more slidable holding means protruding from the surface of the platform. Additional securement means such as conventional vacuum means may be used in conjunction to further secure the window or door frame in position on the platform.

Once correctly positioned and secured onto apparatus platform, machining of the window or door frame may be performed using the machining tools of the apparatus of the present invention. As aforementioned, said machining tools of the apparatus of the present invention may individually and independently be conventional tools for drilling, boring, cutting, slotting, grinding, smoothing, decorating, or affixing hardware onto, the window or door frame members. Preferably, the tools are rotary tools made of high-speed carbide-tipped steel or solid carbide and driven by conventional geared or gearless motor means such as a router, a drill, a circular blade, a rotary saw, a rotary hammer, a rotary grinder and a rotary sander or buffer. For example, typical types of machining requirements of a window or door in terms of hardware application may include, without limitation, drilling of holes for drainage and for fitment of mullions and hinges, routing of slots to accommodate locks and latches as well as mechanisms such as roto-gear or other like devices for opening and closing of the window or door, and potentially slotting of grooves to accommodate window panes.

As described earlier, the multi-directional movements and positioning of the tools of the apparatus of the present invention may be actuated and guided by conventional motor and track means, and preferably, such actuation and guidance are controlled by computer with software adapted to cover a variety of window and door types. In order to maximize the efficiency of the apparatus of the present invention, the one or more overhead machining tool(s) and the one or more side machining tool(s) of said apparatus are capable of independently and simultaneously performing multi-directional machining of the window or door frame members.

Again, the unique ability of the apparatus of the present invention to perform simultaneous machining of more than one surface of the window or door frame, in any of the X, Y or Z directions, at any position within the general confines of the perimeter of the whole assembled window or door frame is requisite for one to be able to successfully and efficiently implement the improved process of manufacture of the present invention.

Other objects, features and advantages of the present invention will become apparent from the following detailed description. It should be understood, however, that the detailed description and the specific examples while indicating preferred embodiments of the invention are given by way of illustration only, since various changes and modifications within the spirit and scope of the invention will become apparent to those skilled in the art from this detailed description.

According to yet another aspect of the present invention there is provided an apparatus for machining a frame belonging to either a window or a door and being formed of elongated frame members joined to each other about a perimeter of the frame, each elongated frame member having a front frame surface, a back frame surface, an inner edge surface, and an outer edge surface, said apparatus comprising:

support means including a pair of parallel elongate work supports supported for movement relative to one another to adjust a spacing therebetween, each support including an upward facing supporting surface for coplanar support of the back frame surface of a respective one of the frame members thereon and a clamping surface extending upwardly from the upward facing supporting surface, the clamping surfaces confronting one another for clamping against the outer edge surfaces of the frame spanning and supported by the elongate supports; and at least one machining tool capable of machining the front frame surface, the inner edge surface, or the outer edge surface of the frame members forming the frame.

BRIEF DESCRIPTION OF THE DRAWINGS

For a more detailed disclosure of the invention and for further objects and advantages thereof, reference is to be had to the following description taken in conjunction with the accompanying drawings, in which.

DETAILED DESCRIPTION

Referring to the accompanying figures, there is illustrated an apparatus of the present invention to improve efficiency, reduce manpower, and reduce wastage of materials, in manufacturing of window and door frames.

One first aspect of the present invention relates to an apparatus for machining a window or door frame having elongated frame members joined to each other defining a perimeter of the window and each elongated frame member having a front frame surface, a back frame surface, an inner edge surface, and an outer edge surface, said apparatus comprising: a platform having a certain length and width defining a perimeter and having a substantially flat surface of sufficient size for substantially coplanar support of the back frame surface of the window or door frame members thereon; two or more slidable holding means protruding from the surface of the platform capable of juxtapositioning against one or more outer edge surface(s) of the window or door frame thereby securely positioning the window or door frame on the platform; one or more overhead machining tool(s) capable of multi-directional machining of the front frame surface and/or the inner or outer edge surfaces of the window or door frame members, each overhead machining tool attached pivotally to XY directional slide means to enable positioning of said underside machining tool(s) at any point substantially within an underside area defined by the perimeter of the window or door frame; and one or more side machining tool(s) disposed along the perimeter of the platform capable of machining of the back frame surface and/or the outer edge surface of the window or door frame members, each side machining tool head attached pivotally to XY directional slide means to support movement of said side machining tool(s) along the perimeter of window or door frame.

Figure 1:
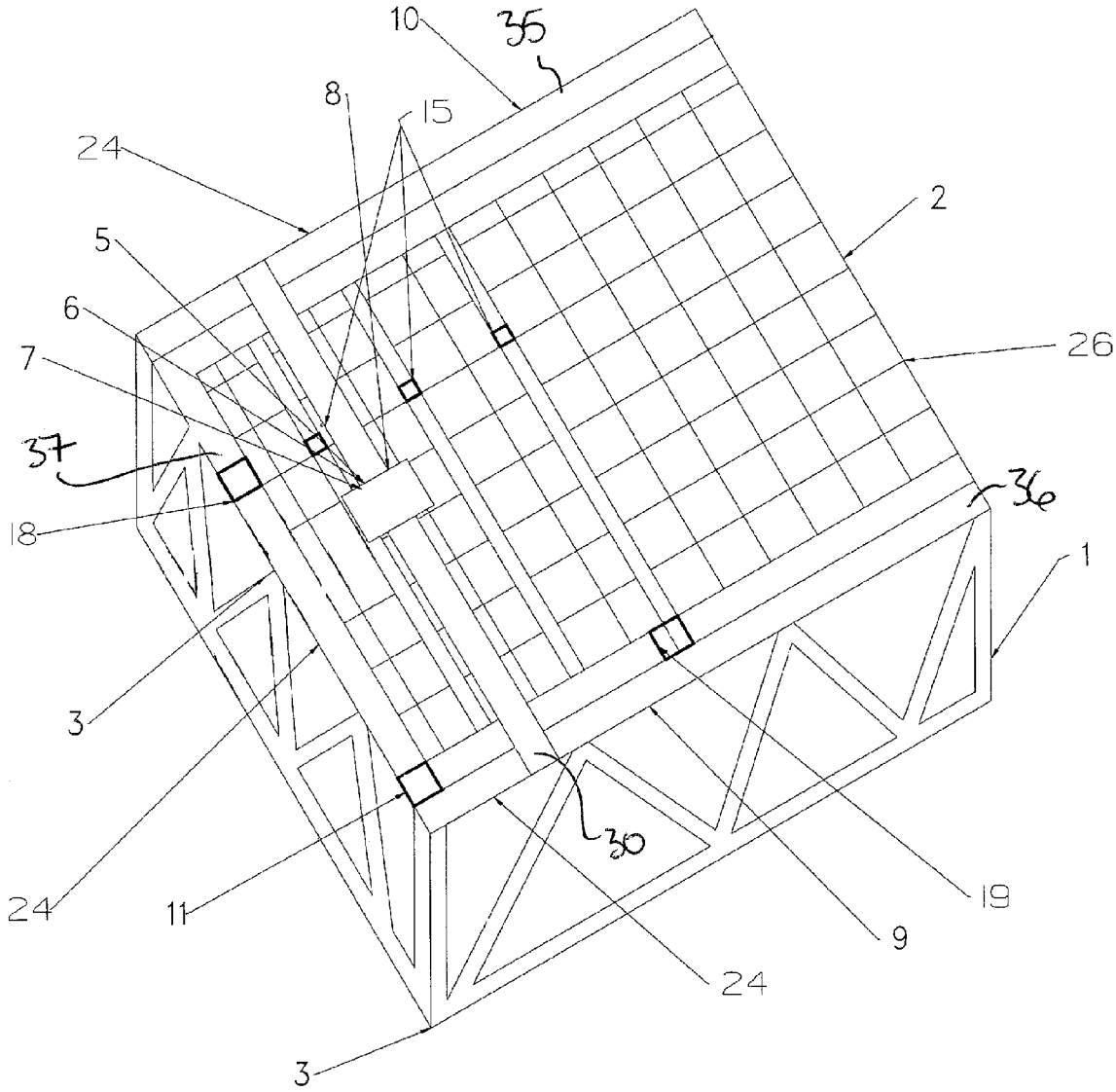
FIG. 1 is a perspective view of a first embodiment of the apparatus according to the present invention.

Referring to FIG. 1 herein, one embodiment of the present invention is illustrated as apparatus 1 for machining a window or door frame having elongated frame members joined to each other defining a perimeter of the window and each elongated frame member having a front frame surface, a back frame surface, an inner edge surface, and an outer edge surface. The apparatus of the present invention has a substantially flat surface or platform 26 having a certain length as defined by the distance between the side 2 and the side 3 of the platform, and certain width as defined by the distance between sides 24 of the platform. The platform is preferably made of a material sufficient structural integrity and it should be readily appreciated by persons skilled in the art that the shape and dimensions of the platform is presented herein as example and that other shapes and dimensions may be used as long as the platform is of sufficient size for substantially coplanar support of the back frame surface of window or door frame members thereon.

With respect to means for holding and positioning of the window or door frame on the platform, slidable holding means 15 protruding from the surface of the platform are capable of juxtapositioning against one or more outer edge surface(s) of the window or door frame thereby securely positioning the window or door frame on the platform. In addition, side sills 9 and 10 may be extended upwards to form ledges to keep the window or door frame within the confines of the working surface of the platform.

One or more overhead machining tool(s) capable of XYZ directional machining of the front frame surface and/or the inner or outer edge surfaces of the window or door frame members are pivotally attached to and housed in a tool head 5 which is slidably disposed on a cross bar 30 spanning the width (or X-direction) of the platform and, when actuated by conventional motor and track means, would enable tool head 5 to travel along cross bar 30 along the width of the platform. Preferably, cross bar 30 is made of a material sufficient structural integrity of an inverted U-shape so that tool head 5 would be of sufficient distance above the platform to accommodate the thickness of the window or door frame as well as the operating distances required for the machining tools in tool head 5. For the present illustration, a first XYZ directional router 6 and a second 360 degree rotatable XY router 7 are housed in tool head 5. As the nomenclature implies, the XYZ directional router 6 can perform machining substantially along the width of the platform, along the length of the platform, and also perpendicularly into the platform. The 360 degree rotatable XY router 7 is relatively inflexible in that the router bit can only point along a plane substantially coplanar with the top flat surface of the platform and cannot perform Z-directional routing substantially perpendicularly into the top flat surface of the platform. Both machining tools are preferably retractable into the tool head when not in use.

In order to enable movement of tool head 5 along the length (or Y-direction) of the platform, the two ends of cross bar 30 is slidably attached to edges 35 and 36 of the platform so that, when actuated by conventional motor and track means, each end of cross bar 30 can slide synchronously along edges 35 and 36 thereby moving tool head 5 along the length of the platform.

In view of the foregoing, it should therefore be apparent to skilled artisans that a controlled combination of widthwise and lengthwise movement of tool head 5 would confer unlimited XY directional mobility of tool head 5 and associated machining tools across the entire surface of the platform, and correspondingly allowing, for example, the XYZ directional router 6 to reach any position within the confines of the perimeter of the platform and to perform XYZ-directional machining of the front frame surface and/or the inner or outer edge surfaces of any window or door frame member placed on the platform.

Further, a two-finger plunger 8 may also be housed in tool head 5 so that, when extended towards the platform at a proper position, the plunger would contact and attach to a window or door frame member and subsequent repositioning of tool head 5 would serve to reposition the window or door frame, for example for loading and unloading of the frame on and off the platform.

For the purpose of this invention, one specific advantage of the apparatus is that it is able to independently and simultaneously machine the front frame surface of the elongated frame members of the window or door frame as well as an inner edge surface, an outer edge surface, or the back frame surface of the frame members.

In one embodiment, in addition to the overhead tool head 5, the apparatus of the present embodiment additionally includes a side machining tool 18 disposed along the X-directional perimeter channel 36 and another side machining tool disposed along the Y-directional perimeter channel 37 of the platform. Said side machining tools 18 and 19 are preferably retractably disposed in channels 37 and 36 respectively and that they are pivotally attached a motor and track means so that they can travel along 37 and 36 and perform Z-directional machining as well as X and Y-directional machining steps, respectively.

In another embodiment, the apparatus of the present invention comprises an overhead machining tool(s) and cross bar setup as described above coupled with an equivalent setup on and for the underside of the platform. Essentially, the underside setup is a mirror image of the overhead setup in that one or more underside machining tool(s) capable of multi-directional machining of the back frame surface, the inner edge surface, or the outer edge surface, of the window or door frame members are pivotally attached to and housed in a tool head which is slidably disposed on a cross bar spanning the width (or X-direction) of the underside of the platform and, when actuated by conventional motor and track means, would enable this underside tool head to travel along the underside cross bar along the width of the platform. Preferably, the underside cross bar is of a U-shape so the underside tool head would be of sufficient distance away from the underside of the platform so to accommodate the operating distances required for the underside machining tools. Again, the underside tool head may comprise of a first XYZ directional router and a second 360 degree rotatable XY router. The mechanisms enabling movement of the underside tool head and tools are again analogous to the ones described above for the overhead tool head setup and should be readily apparent to persons skilled in the art.

Figure 2:
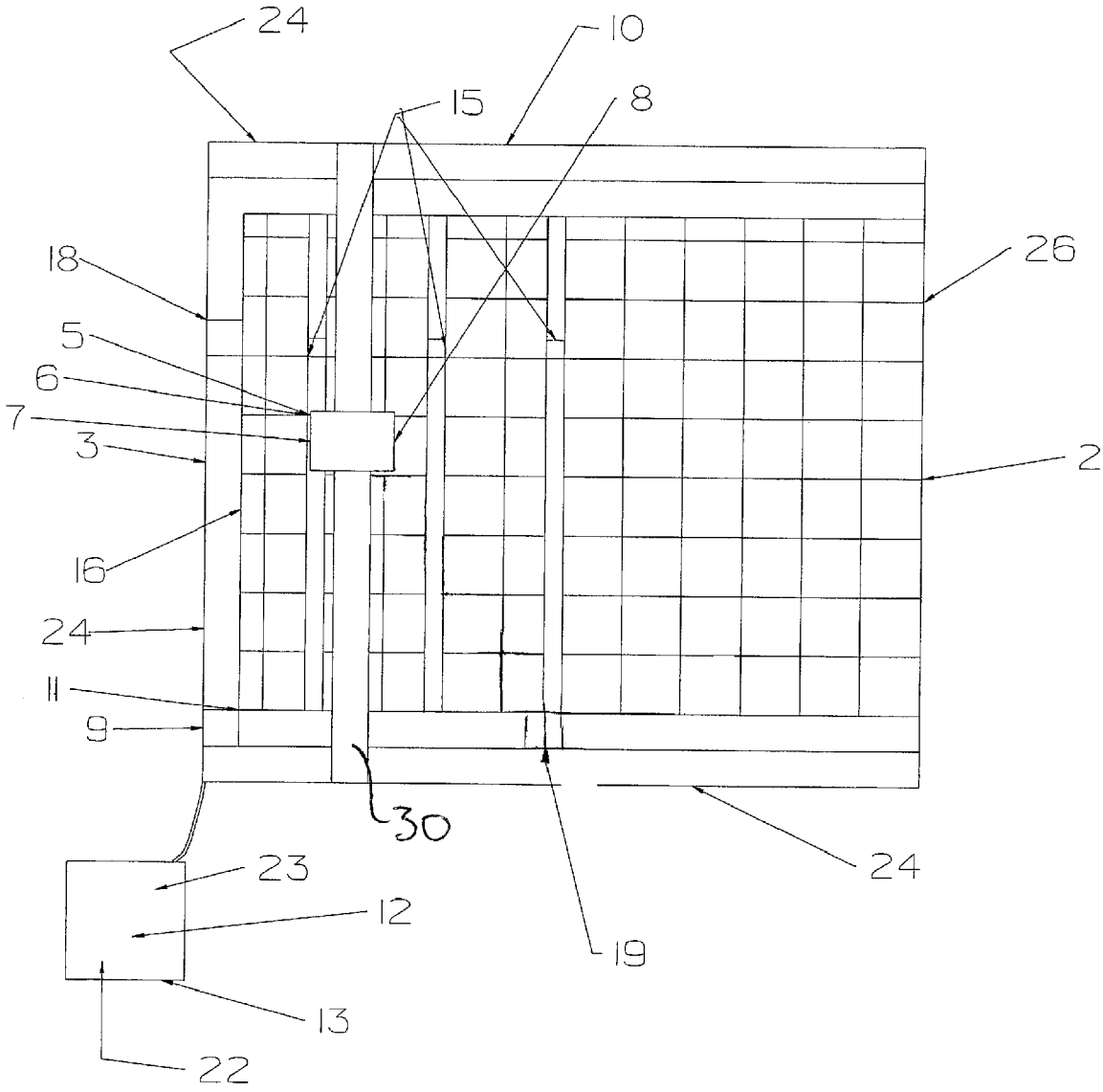
FIG. 2 is a top plan view of the apparatus of FIG. 1.
Figure 3:
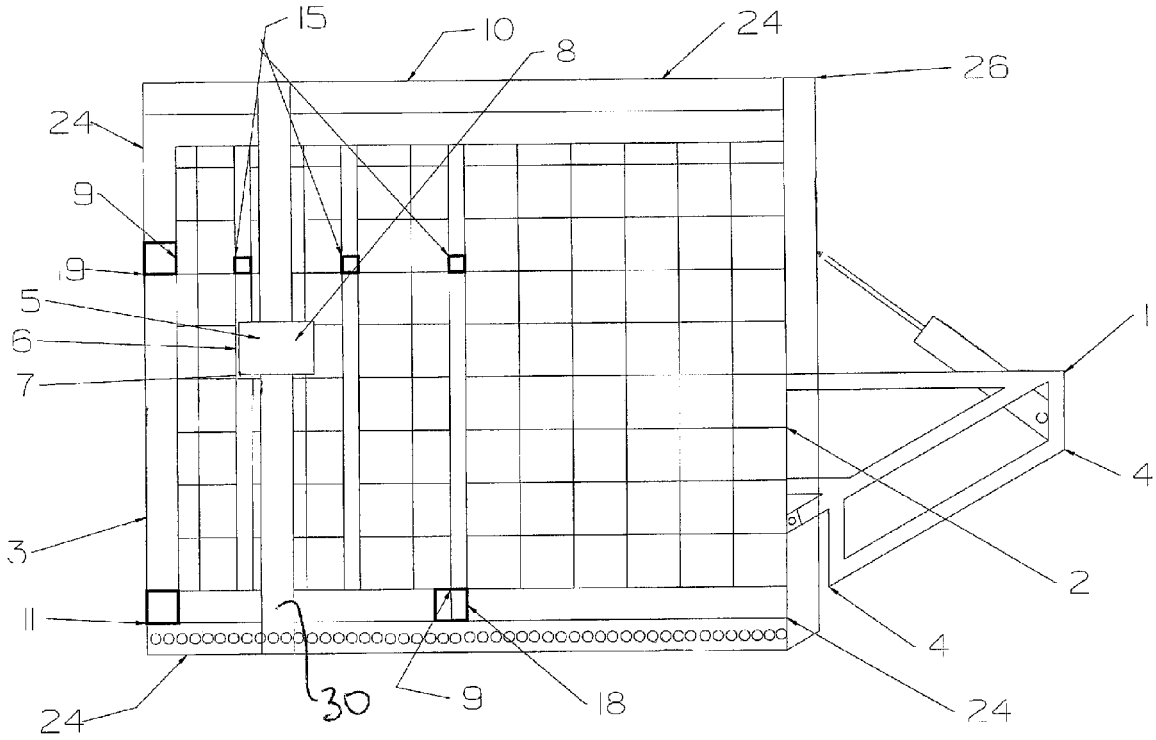
FIG. 3 is a top plan view of the apparatus further illustrating the computer controls for same in accordance with the embodiment of FIG. 1.
Figure 4:
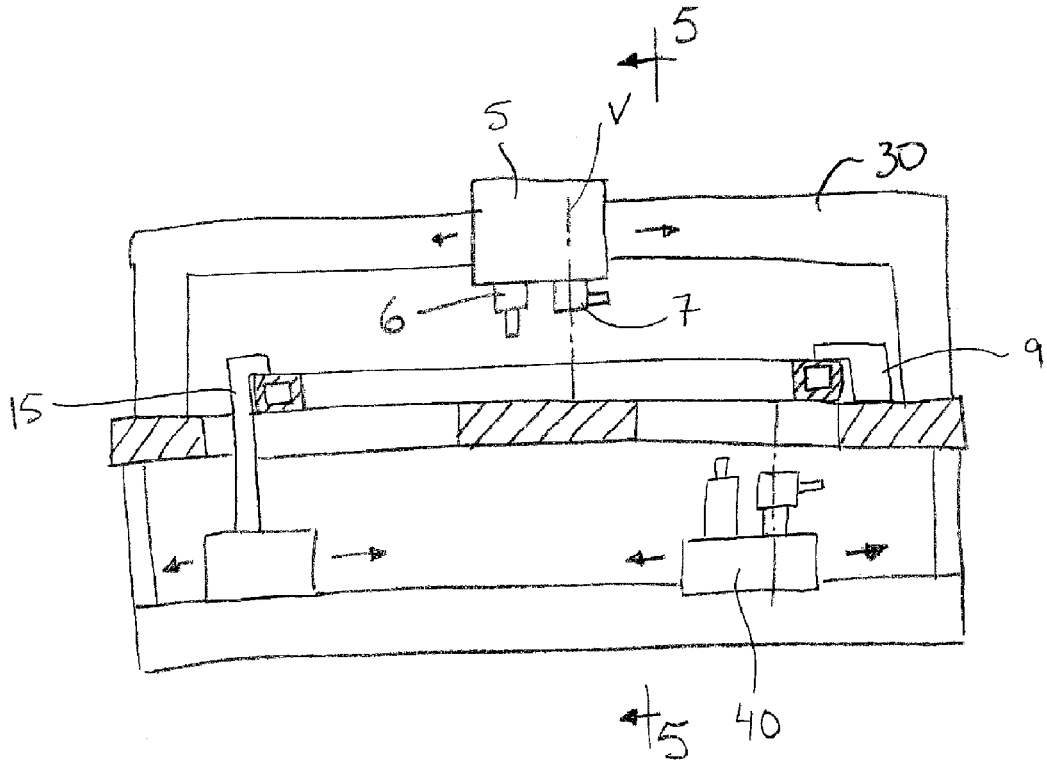
FIGS. 4 and 5 are front and side elevational views respectively of the first embodiment of the apparatus.
Figure 5:
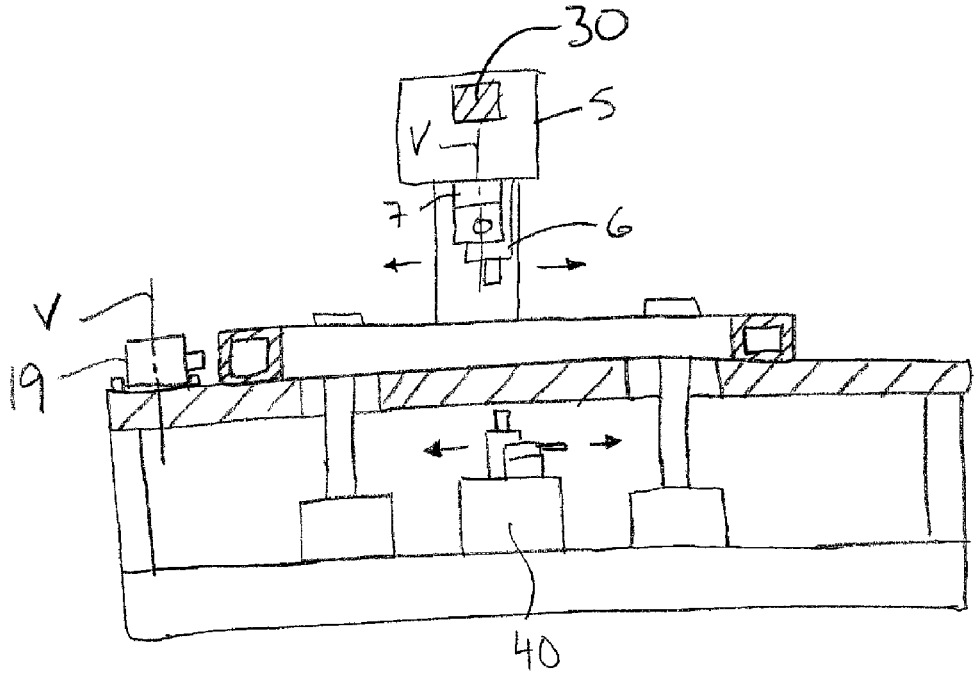

With respect to the control of the apparatus of the present invention and the associated machining tools, the multi-directional movements and positioning of the tools of the apparatus of the present invention is actuated and guided by conventional motor and track means which preferably are controlled by computer with software adapted to cover a variety of window and door types. Referring to FIG. 2, computer 13 with CPU 22, built-in monitor 12 and manual input keyboard 23 are connected to the motor and track means in the apparatus for controlling movement and machining of the machining tools. In order to further facilitate the manufacturing process, the apparatus illustrated in FIG. 2 further comprises a bar-code scanner 11 which is able to scan a variety of bar codes attached to different window and door frames and inputting the applicable data to computer 13 to automatically activate the appropriate program for machining the particular frame that is placed on the platform.

In summary, an apparatus is described herein for the machining of frames for doors and windows. The apparatus includes a support surface which is generally planar, spanning longitudinally between ends 2 and 3 and spanning laterally between sides 24. A plurality of openings is formed in the support surface for receiving machining tools and clamping members of the holding means therethrough. The machining tools include the overhead machining tool 5, noted above, having a first router 6 movable laterally and longitudinally across the support surface parallel thereto as well as being movable perpendicularly to the supporting surface in a third direction. A second router 7 on the overhead tool 5 is also movable laterally and longitudinally parallel to the support surface while being rotatable about a vertical axis V lying perpendicular to the support surface. The side machining tools 18 and 19, noted above, are slidable parallel to the support surface which being rotatable about a respective vertical axis V. The underside machining tool 40, also noted above, is similar in configuration to the overhead tool 5 so as to be movable laterally and longitudinally while including a component movable perpendicularly to the support surface and a further component rotatable about an axis lying perpendicular to the support surface. The frames are held on the support surface by holding means including fixed clamps 9, 10 which are fixed in relation to the support surface and movable clamps 15 which are slidable relative to the fixed clamps and extend through the openings in the support surface.

Figure 6:
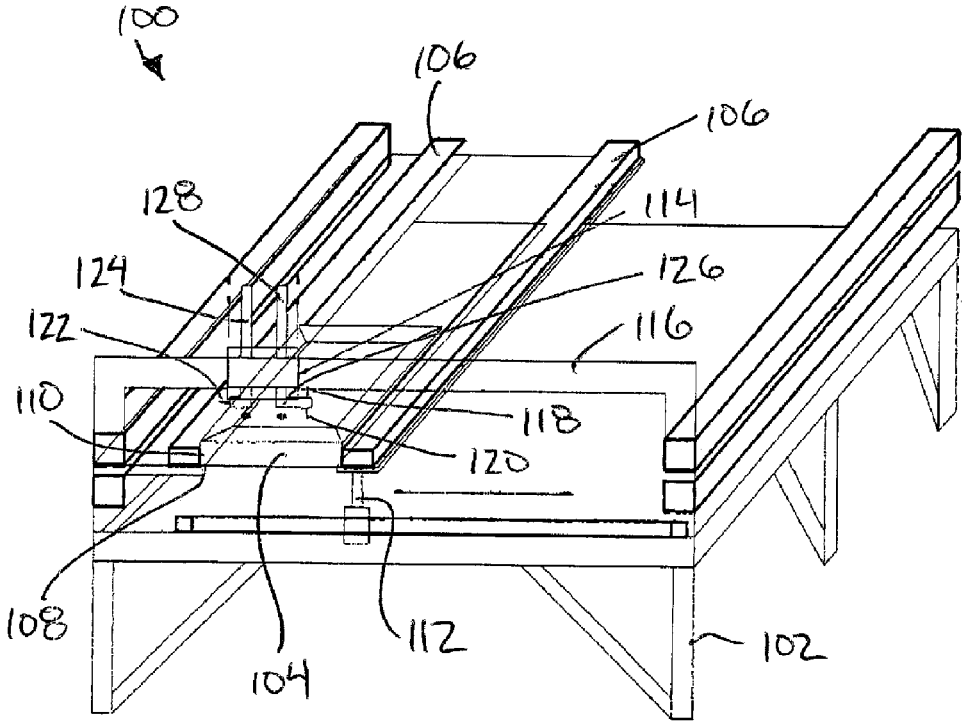
FIG. 6 is a perspective view of a further embodiment of the apparatus according to the present invention.
Figure 7:
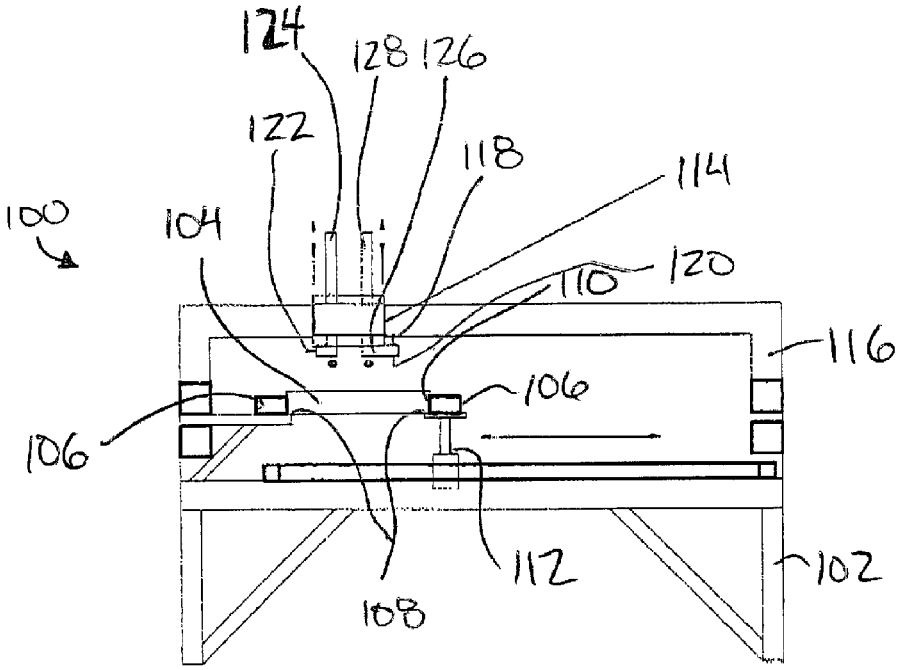
FIGS. 7 and 8 are respective side elevational and top plan views of the apparatus according to FIG. 6.
Figure 8:
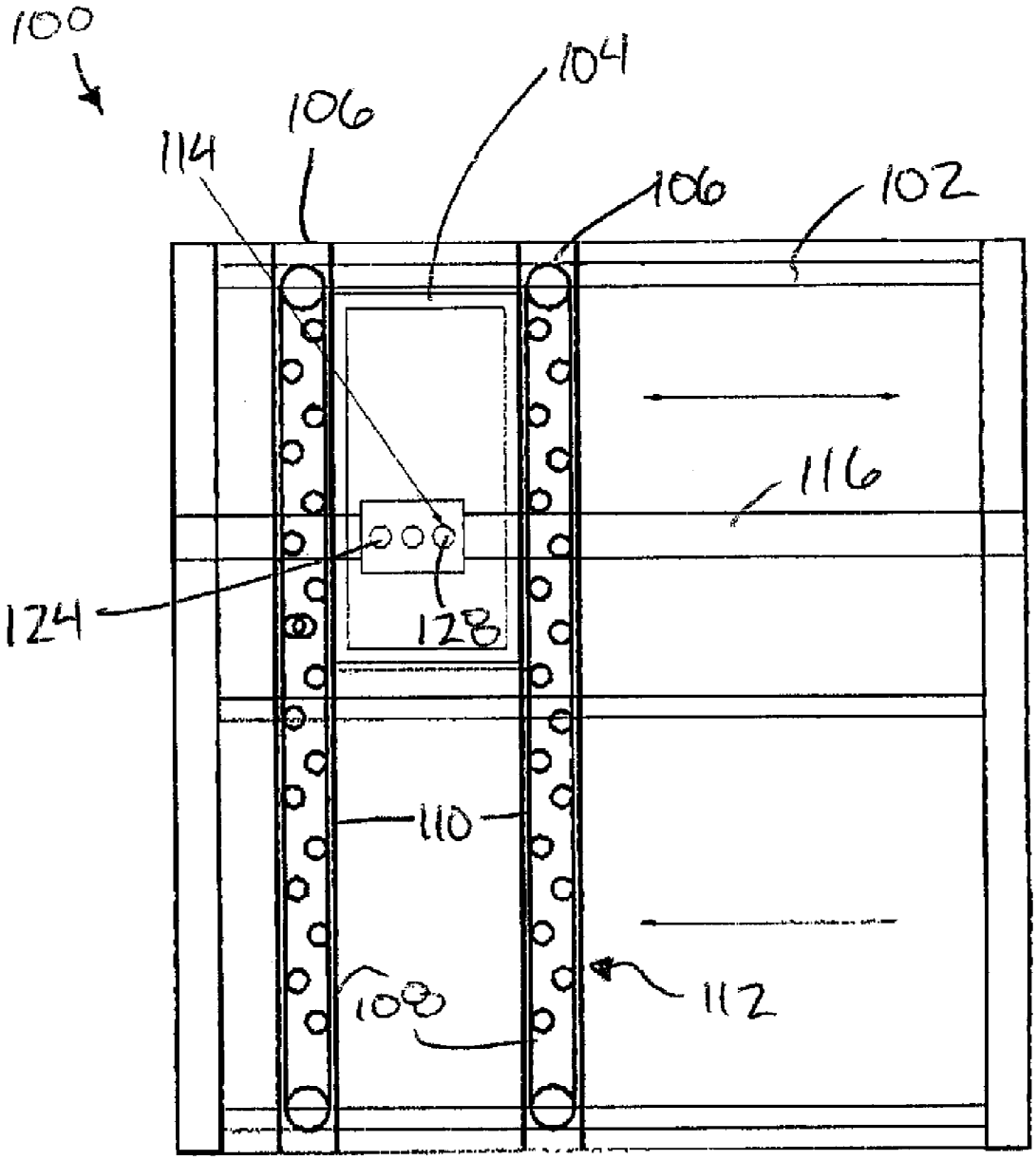

Turning now to FIGS. 6 through 8, a second embodiment of the apparatus is generally indicated by reference 100. The apparatus in this instance includes a base frame 102 for supporting the apparatus on a level supporting surface such as floor and the like. The base frame mounts a supporting structure thereon for supporting a work piece such as a window frame 104 as illustrated in the Figures. As in the previous embodiment, the window frame is formed of frame members which have been joined at the corners of a rectangular perimeter. The frame members may be formed of PVC, fiberglass, aluminum or any other suitable material known in the manufacture of windows and door frames. Each frame member includes a back surface, a front surface and opposed inner and outer edge surfaces.

The supporting structure generally includes a pair of work supports 106 in the form of elongate rails which are mounted parallel and spaced apart from one another. Each work support includes an upward facing supporting surface 108 which is co-planar with the supporting surface of the opposing work support for co-planar support of the back surfaces of opposing frame members of a frame supported on the apparatus. Each work support also includes a clamping surface 110 which is oriented perpendicularly to the supporting surface 108 spaced outwardly from an inner edge of the supporting surface and confronting the opposing work support so that each work support comprises a generally L-shaped clamping member for clamping against opposing outer edge surfaces of a window frame 104 supported therebetween.

One of the work supports 106 remains fixed along one side of the base frame 102 while the opposing work support 106 is supported on a movable carriage 112 for movement towards and away from the fixed work support for adjusting a spacing therebetween to accommodate various sizes of window frames 104. The movable carriage 112 is provided with an actuator which provides a clamping force to adequately secure the frame in place during the machining process. The supporting surface 108 of each work support projects inwardly from the respective clamping surface 110 a distance which is considerably narrower than the width of a frame member of the window frame 104, for example the width of the supporting surface 108 is preferably substantially less than one inch. In this manner a majority of the back surface of the window frame being supported remains exposed for machining operations without movement of the frame being required.

A machining tool 114 is supported on an overhead mechanism 116 for adjustably positioning the machining tool relative to the window frame 104. The overhead mechanism 116 is suitably arranged with longitudinally and laterally extending tracks so that the tool 114 is movable longitudinally a full length of the supports and laterally a maximum width of the supports when spaced from one another.

The machining tool 114 includes an upward projecting bit 118 and a downward projecting bit 120 oriented perpendicularly to the supporting surfaces of the work supports, as well as a laterally projecting bit 122 which projects parallel to the supporting surfaces of the work supports. The lateral projecting bit 122 is supported at the base of a vertical post 124 on the machining tool which is movable both vertically in a sliding motion and is rotatable about a vertical axis extending longitudinally of the post 124 to orient the lateral bit 122 to bore into any one of the inner and outer edge surfaces of the frame members about a full periphery of the window frame 104. The upward and downward projecting bits 118 and 120 are commonly mounted on opposing surfaces of a horizontal arm 126 at spaced positions from a vertical post 128 from which the arm 126 projects. The post 128 is similarly mounted on the tool 114 for vertical sliding movement and for rotation about a vertical axis extending longitudinally of the post 128.

In this arrangement the horizontal arm 126 may be lowered through the opening the frame between the work supports and extended in either longitudinal or lateral directions to be raised upwardly below the back surface of any one of the frame members of the window frame. Similarly the arm 126 may be positioned above the window frame 104 so that the downward projecting bit 120 may be lowered downwardly into any one of the front surfaces of the frame members of the window frame. The combination of bits provided on the tool 114 ensures that all surfaces with the exception of two opposed outer edge surfaces clamped by the work supports 106 can be readily accessed and machined without reconfiguring the work supports 106 supporting the window frame.

Turning now to FIGS. 9 through 15, a further embodiment of the apparatus for machining a frame is generally indicated by reference numeral 200. The apparatus 10 is particularly suited for machining window or door frames formed of elongate frame members which have been joined together prior to machining mounting holes for locking members, hinges and the like.

Figure 9:
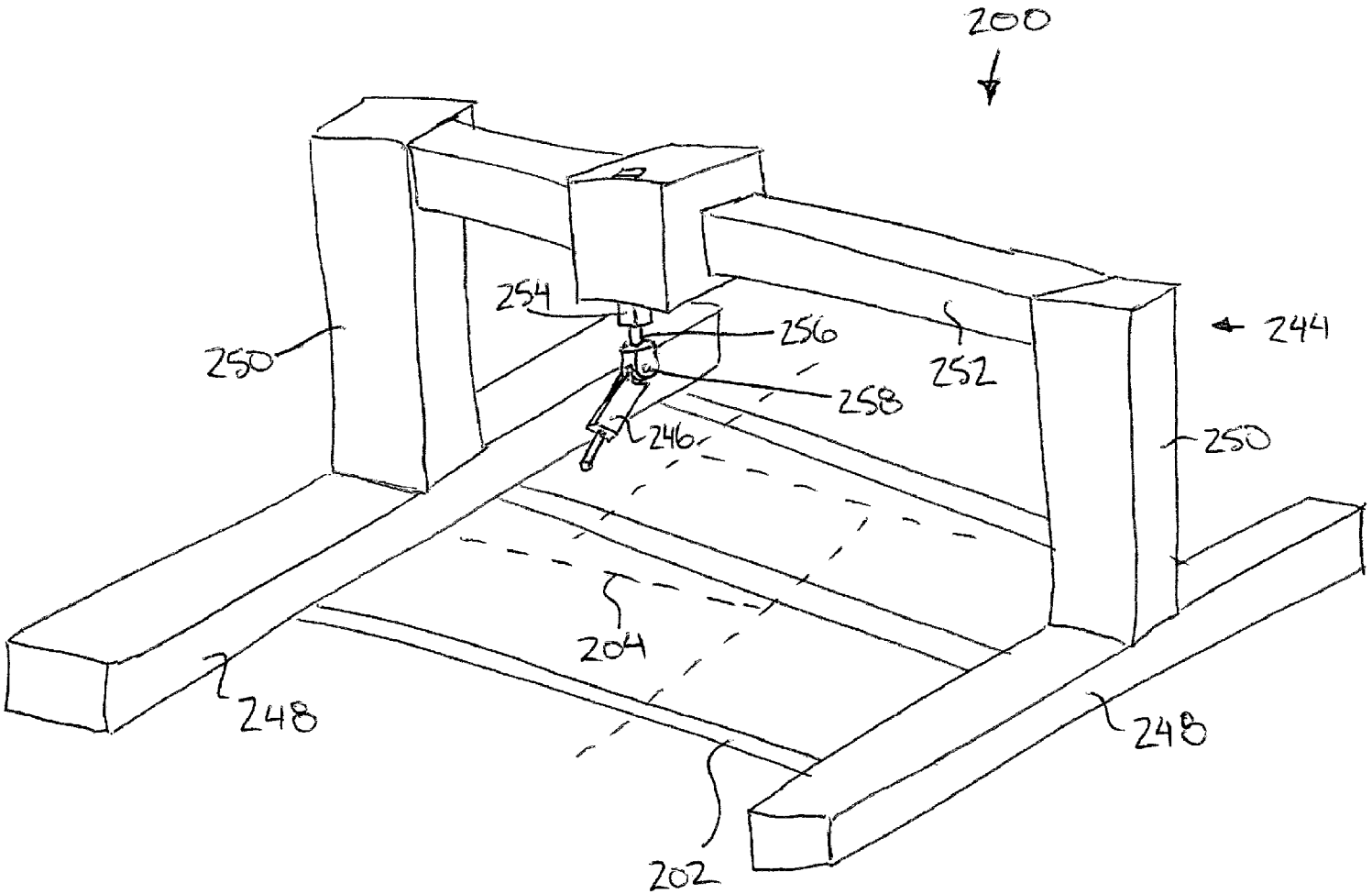
FIG. 9 is a perspective view of an overhead mechanism for supporting the tool head according to a further embodiment of the apparatus according to the present invention.
Figure 10:
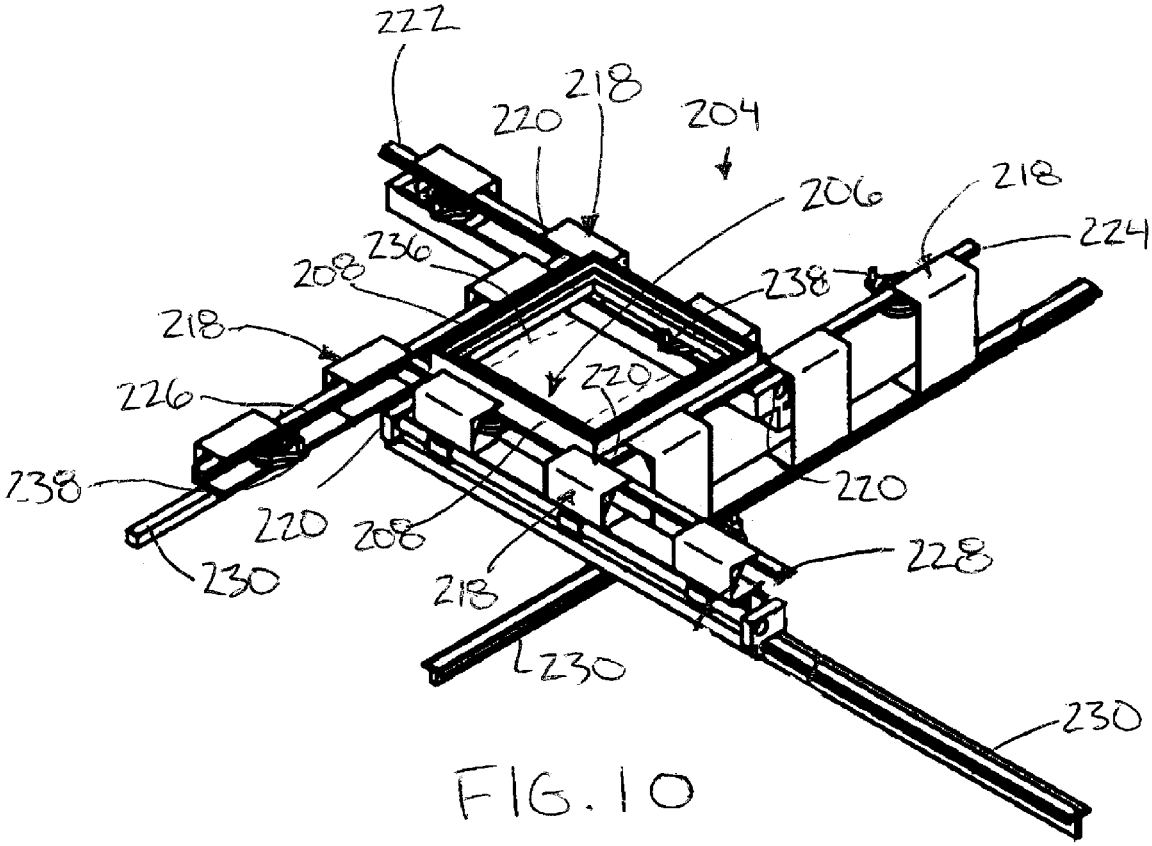
FIGS. 10 and 11 are perspective and top plan views respectively of the supporting structure according to the apparatus of FIG. 9 in a clamping position.
Figure 11:
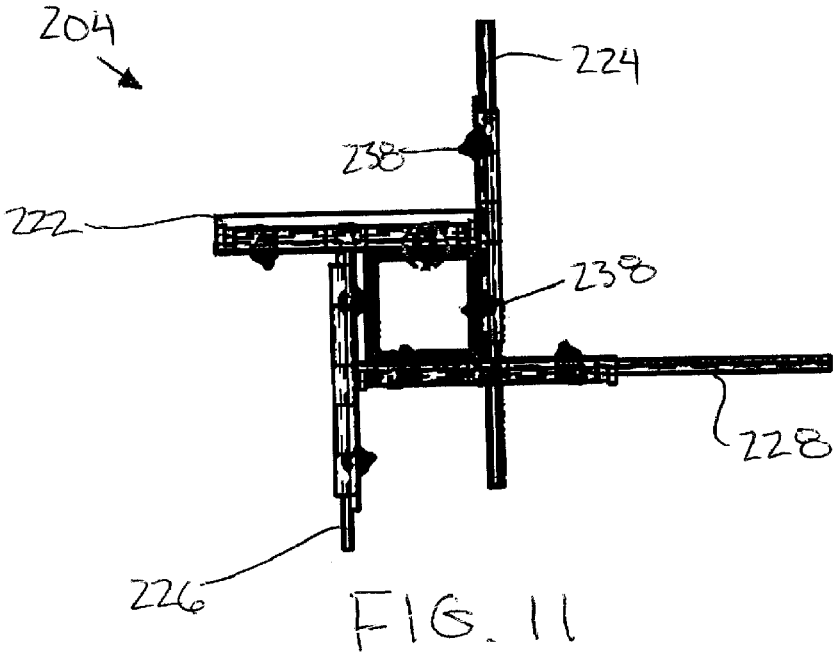

As shown specifically in FIG. 9, the apparatus 200 includes a base frame 202 upon which a supporting structure 204 is mounted. The supporting structure 204 is configured for automatically loading, supporting and unloading window or door frames therefrom regardless of the particular dimensions of the frames. The supporting structure is shown in further detail in FIGS. 10 through 13.

Each window frame 206 in the illustrated example is formed of a plurality of elongated frame members 208 joined together at mitered corners in a rectangular configuration. The elongate frame members 208 may be formed of fiberglass, plastics, for example PVC or metals, including various alloys or aluminum. The assembled frame members define a window frame having a front frame surface 210 and a back frame surface 212, each of which include a portion of each elongate frame member. The frame 206 further includes outer edge surfaces 214 spanning between the front and back surfaces so that the outer edge surfaces face away from each other in an outward direction. Corresponding inner edge surfaces 216 confront one another and face inwardly towards a center of the frame.

Figure 12:
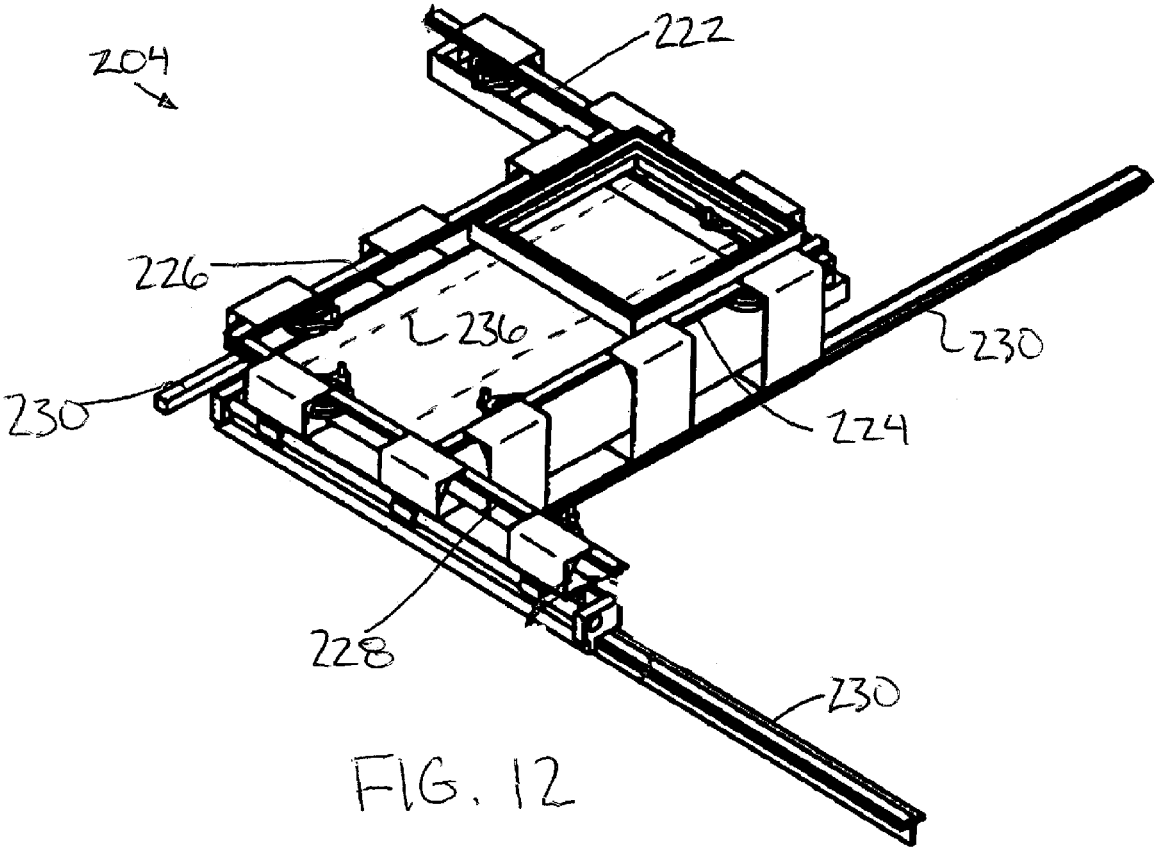
FIGS. 12 and 13 are perspective and top plan views respectively of the supporting structure in a partially released clamping position.
Figure 13:
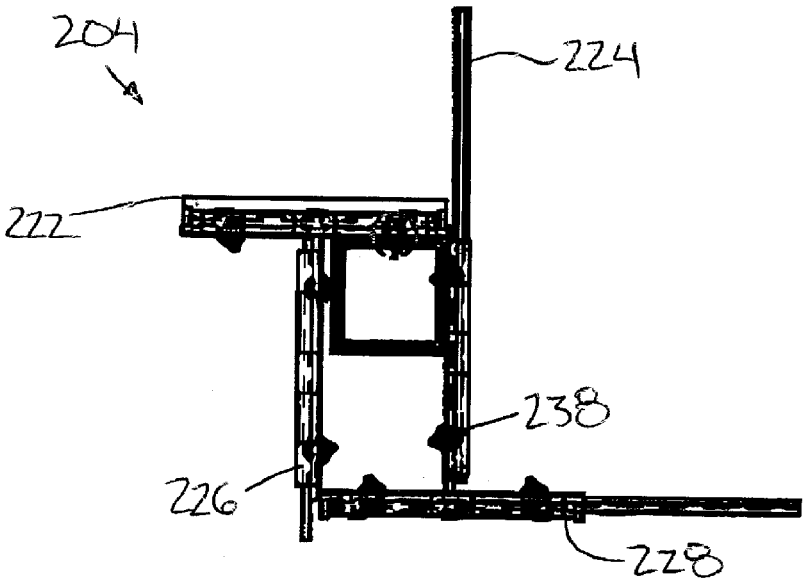

The supporting structure 204 includes two pairs of parallel and opposed work supports 218. The four work supports are supported in a rectangular configuration for sliding movement relative to one another for adjusting the area spanning therebetween so that any number of different sizes of window or door frames can be received between the work supports, clamped between each opposing pair thereof. The sliding movement of each work support relative to the adjacent supports permits the rails to be slidably opened and closed from the clamped position of FIG. 10, to a partially released position as shown in FIG. 12 and subsequently to a fully released position which is not shown in which one of the pairs of work supports is pivoted out of the way whereby the window frame is unobstructed to be slidably removed in the longitudinal direction of the remaining work supports supporting the frame thereon.

The work supports are arranged such that each one abuts at an inner end 220 to an adjacent work support at a mid-point therealong, perpendicularly thereto so as to be slidable along the work support which it abuts. A first one of the work supports 222 is fixed in relation to the base frame 202. A second work support 224 is oriented perpendicularly to the first work support at the abutted end 220 for sliding movement in a longitudinal direction of the second work support in relation to the fixed work support. A third work support 226 has its abutted end 220 slidably supported on the fixed rail for movement in the longitudinal direction of the rail while maintaining the third work support 226 perpendicular to the fixed work support. A fourth work support 228 is slidable in two directions by anchoring its abutted end 220 slidably on the third support 226 while being slidable with the third support 226 in the longitudinal direction of the first support 222.

Each of the slidable work supports are supported on a respective rail 230 which is fixed on the base frame while supporting the respective work support thereon for longitudinal sliding movement. Suitable motor controls are provided for operating the location of the work supports along the rails. The rail 230 of the fourth work support is slidably supported along the rail of the second work support to create the two degrees of freedom of the fourth rail.

Each of the work supports is generally L-shaped and includes a supporting surface 232 and a clamping surface 234 which are oriented perpendicular to one another. The supporting surface 232 is positioned generally horizontally in a common plane with the supporting surface of the remaining work supports for supporting the bottom frame surface of the window frame 206 thereon.

The clamping surface 234 is moveable with the supporting surface 232 between the released and clamped positions of the work supports. The clamping surfaces 234 are thus arranged in opposing pairs spaced apart and parallel to one another for clamping against opposing outer edge surfaces of a window frame therebetween. Suitable actuation is provided to secure the window frame with a clamping force between the opposing pairs of work supports.

The fixed support 222 and the opposing fourth support 228 having two degrees of freedom are each pivotally supported about a horizontal axis extending longitudinally parallel thereto for pivotal movement relative to the base frame in a released position. The pivot axis is located near an inner edge of the supporting surface 232 so that the supporting surface and the associated clamping surface 234 pivot downwardly and away from the window frame as well as away from each other into the released position so that when these work supports are in the released position the window frame is unobstructed from longitudinal sliding movement parallel to the longitudinal direction of the remaining two work supports.

The remaining two work supports can be slightly released from one another so as to be disengaged from frictional engagement with the window frame therebetween so that the window frame is instead supported on conveyors 236 supported along side each of the remaining work supports 224 and 226. The conveyors 236 each generally comprise a belt having an upper surface lying in a common plane with the supporting surfaces for carrying a window frame therealong for sliding movement in relation to the surrounding work supports for automatically loading and unloading window frames from the supporting structures.

Figure 14:
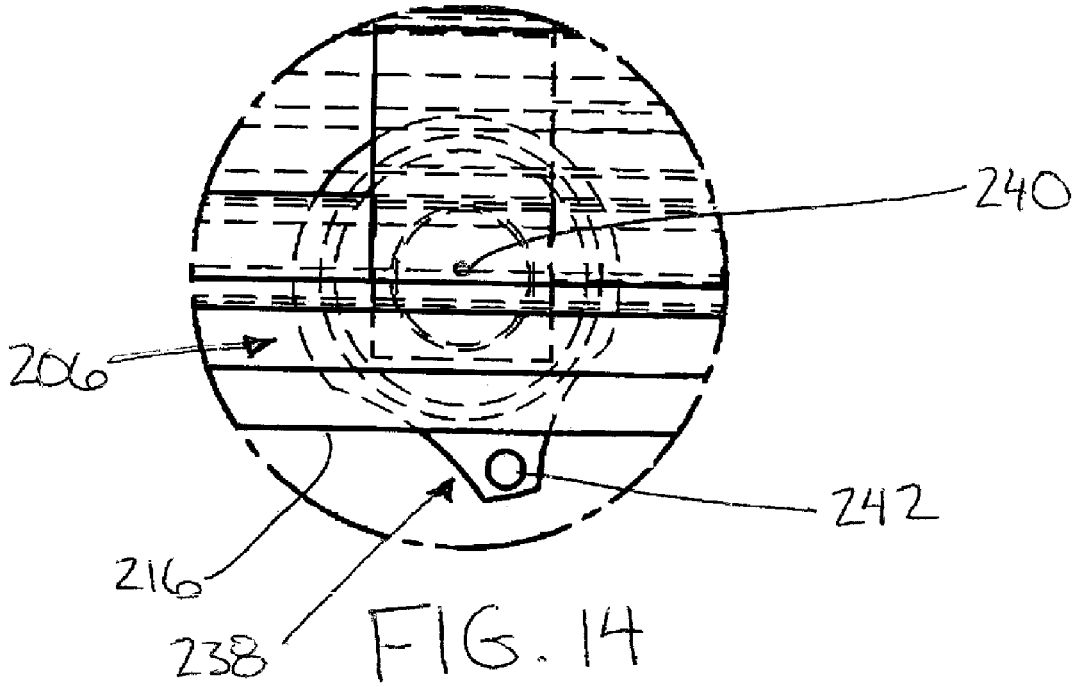
FIG. 14 is an enlarged plan view of one of the clamping members of the supporting structure of the embodiment of FIG. 9.
Figure 15:
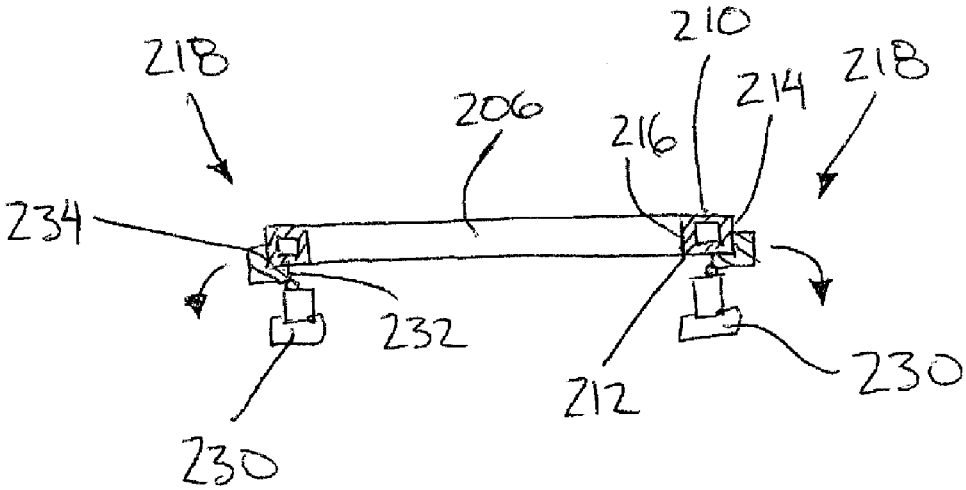
FIG. 15 is a partly sectional side elevational view of a window frame in the clamped position of FIG. 10.

Each of the work supports includes a clamping member 238 mounted thereon which is supported for longitudinal movement along the work support for being located at the center of the frame member of the window frame supported on that work support regardless of the dimensions of the window frame. An enlarged view of the clamping member 238 is shown in FIG. 14. A rack and pinion configuration with suitable automated motors are provided for positioning the clamping members. Each clamping member includes a main body rotated on a vertical axis 240 for pivotal movement between a clamped and released position with the frame member. A pin 242 is supported on the body, spaced radially from the vertical axis 240 with the vertical axis being positioned near the inner edge of the supporting surface so that rotation of the body causes the pin 242 to move towards and away from the inner edge surface of a window frame supported on the supporting surface of the respective work support. The pin 242 is supported for vertical sliding movement between an engaged position extending above the common plane of the supporting surfaces for engaging the inner surface of the window frame and a disengaged position supported entirely below the supporting surfaces of the work supports so that the window frame can be slidably unloaded or loaded onto the supporting structure of the apparatus without obstruction from the clamping members. In use the clamping members are positioned near a longitudinal center of each elongated frame member forming the window frame so that pressure can be applied to hold a center of the frame members against the respective clamping surface of the work supports, thus removing any bowing of the frame members resulting from heat applied during welding operations and the like.

Similarly to previous embodiments, of an overhead mechanism 244, as shown in FIG. 9, supports a machining device 246 adjustably in relation to the supporting structure supporting the window frame thereon. The overhead mechanism includes a pair of spaced apart floor rails 248 extending along the base frame at each side of the apparatus upon which a pair of vertical posts 250 are supported for longitudinal sliding movement along the respective rails. An overhead beam 252 is connected between the vertical posts and supports the machining device 246 slidably thereon for sliding movement between the vertical posts 250. The beam in this configuration is supported for sliding movement longitudinally along the floor rails 248 substantially a full length of the window frame while the machining device 246 is supported slidably on the beam laterally for movement substantially a full width of the frame member to locate the machining device at any location along the perimeter of the window frame. The machining device 246 includes a vertical slide 254 for vertical movement of the machining device up and down, a vertical pivot shaft 256 for rotation of the machining device about a vertical axis, and a horizontal pivot shaft 258 at a bottom end of the vertical pivot shaft for pivotal movement of the bottom end of the machining device about a horizontal axis. The machining device 246 supports various interchangeable tool heads thereon including different sizes of downward projecting cutting bits and U-shaped tool heads including upward projecting tool bits.

A suitable computer control operates all of the motors controlling the different movements of the five degrees of freedom of the machining device 246 in relation to the base frame as well as controlling rotation of the bit within the tool head about its own respective longitudinal axis in relation to the machining device 246 supporting the tool head thereon. With this configuration of bits and the degrees of freedom provided by the overhead mechanism, the machining device is capable of machining the front frame surface, the inner edge surface or the outer edge surface of the frame members forming the frame.

The clamping surfaces and the supporting surfaces of the work support are all considerably narrower than the edges of the window frame supported thereagainst, for example the surfaces are an inch in width or less, so that the surfaces of the window frame which are engaged are minimal to provide maximum access for machining bits and the like to do all required machining operations with a single positioning of the window frame within the supporting structure of the apparatus.

The apparatus described herein permits elongate frame members to be joined to form the perimeter of a window or door frame by welding operations and the like prior to subsequent machining of mounting locations for locks, hinges or other hardware associated with windows and door frames. At least one pair of parallel elongate work supports are supported for movement relative to one another for clamping a window frame therebetween. A suitable overhead mechanism which supports an interchangeable tool head thereon for sliding movement a full length and a full width of the window frame readily permits all mounting locations to be machined into a window frame subsequent to assembly of the frame members into the frame in a single operation and a single positioning of the window frame.

In summary, the apparatus consists of two major components, the fixture and the router. The fixture forms the base part of the overall machine. The fixture holds the window while the router spindle cuts the features in the frame. The fixture consists of three sliding rails and a fixed work support. The fourth work support has two sliding degrees of freedom, whereas the second work support is 90 degrees to the fourth one and has one sliding degree of freedom. The third work support is 90 degrees to the fourth support and also has one sliding degree of freedom. The first work support which is parallel to the fourth one does not slide. When the first and third work supports move together, the window frame size becomes more narrow or wider. When the first and second work supports move together the window frame size becomes shorter or longer. This formation allows the fixture to adjust to any length or width dimension combination. The second and third work supports have conveyor belts associated therewith, which move the window into and out of the fixture.

As described above, the first and fourth work supports each have 1 degree of rotational freedom. This rotation allows each of the rails to roll "open" and out of the way thus allowing the window frame to enter and exit the fixture. During loading and unloading of a window frame, the first and second work supports slide back to the home position such that the ends of the second and third work supports are parallel. The conveyor belts will draw a new frame in and expel the processed frame. Once the unprocessed frame has advanced past the first work support and the processed frame has passed the fourth work support, these work supports will roll closed. The conveyors will continue to move the unprocessed window frame into the fixture until it comes to rest against the fourth work support. The first and second work supports will now slide forward until the first work support comes to rest against the window frame.

Also as noted above, on each of the four work supports there are positional clamps, which push the center of the frame sides out and tight against the work supports. This eliminates the natural bow in the window frame sides, which is created by the corner-welding machine. As well, attached to the positional clamps are plungers, which push the frame down into the base of the rail to ensure that the windows frame is firmly held down. The position clamp and pin or plunger assembly are mounted to linear slides and moved by a rack and pinion system. This allows the clamp to be positioned anywhere along the length of the rail. The clamping force comes from a rotational mechanism and retractable pin against the window frame.

In the preferred embodiment, the router spindle or machining device consists of a servo driven spindle capable of automatic tool head changing mounted to a two-axis servo driven spindle head. The spindle head rotates the router spindle clockwise and counter clockwise. As well, it tilts the router spindle up and down. The spindle head is mounted to a vertical tower, which moves the complete spindle head up and down. The vertical tower is mounted to a bridge beam and slides, which straddles the width of the fixture. The vertical tower moves from left to right across the width of the Bridge is secured to two vertical side posts on either side of the fixture. The vertical side posts are mounted to slides, which allow the forward and backward movement of the bridge.

The combined motion of the above components allows the window frame cutter 5 degrees of freedom as well as its rotational cutting. A CNC controller will control these six axes of motion.

Having illustrated and described the principles of the invention in a preferred embodiment, it should be appreciated to those skilled in the art that the invention can be modified in arrangement and detail without departure from such principles. All modifications coming within the scope of the following claims are to be claimed.

All publications, patents and patent applications referred to herein are incorporated by reference in their entirety to the same extent as if each individual publication, patent or patent application was specifically and individually indicated to be incorporated by reference in its entirety.

The embodiment of the invention in which an exclusive property or privilege is claimed are defined as follows:

1. A method of manufacturing a frame for either a door or a window, said method comprising:

providing a plurality of elongated frame members;

joining at least some of the elongated frame members to each other at ends thereof to form a generally planar perimeter frame surrounding an open interior for receiving glazing;

the perimeter frame having a front frame surface on a front side of the perimeter frame facing forwardly from a common plane of the perimeter frame, a rear frame surface facing rearwardly from the common plane of the perimeter frame, an inner edge surface facing inwardly into the open interior, and an outer edge surface of the frame members facing outwardly away from the open interior;

providing a frame mounting assembly arranged in said common plane for supporting the perimeter frame having at least one pair of parallel elongate work supports supported for movement relative to one another in said common plane to adjust a spacing therebetween, each work support including at least one clamping surface;

clamping the at least one clamping surfaces against at least a portion of the outer edge surfaces of opposing ones of the elongated frame members forming the perimeter frame;

providing a movable support mechanism supporting a machining device thereon which supports an interchangeable tool head therein;

providing relative movement between the frame mounting assembly and the movable support so as to allow movement of the machining device along substantially a full length of the frame and laterally substantially a full width of the frame and at right angles to the common plane; and machining at least some of the front frame surface, the inner edge surface, the outer edge surface and the rear frame surface of the frame members forming the perimeter frame.

2. The method according to claim 1 wherein the work supports include respective supporting surfaces lying in a generally common plane with one another for supporting the rear frame surface thereon, wherein the supporting surfaces are moveable with the clamping surfaces towards and away from one another.

3. The method according to claim 1 wherein including machining all required machining operations on the front frame surface, the inner edge surface, the outer edge surface and the rear frame surface of the frame members forming the perimeter frame with the frame supported in one position on the work supports.

4. The method according to claim 1 including machining both the front frame surface and the rear frame surface of the frame supported in a single position on the work supports.

5. The method according to claim 1 wherein the clamping surfaces of the work supports are substantially narrower than the rear frame surface of the frame members of the frame.

6. The method according to claim 1 wherein said at least one pair of parallel elongate work supports comprises two pairs of work supports supported in a rectangular configuration in which each work support is abutted in sliding relationship along an adjacent one of the work supports.

7. The method according to claim 6 wherein one of the work supports is fixed, two of the work supports are slidable in one direction and one of the work supports is slidable in two directions.

8. The method according to claim 6 wherein one pair of work supports are supported for pivotal movement away from one another into a released position.

9. The method according to claim 1 including clamping each inner edge surface of the window frame against the respective clamping surface using a clamping member wherein the clamping member is supported for movement along the respective work support.

10. The method according to claim 1 including machining the rear frame surface by causing the tool head to pass through the common plane in the open interior.

11. The method according to claim 1 including providing each work support with a clamping member arranged to clamp a respective one of the surfaces of the frame and arranging each clamping member for movement relative to the respective work support.

12. A method of manufacturing a frame for either a door or a window, said method comprising:

providing a plurality of elongated frame members;

joining at least some of the elongated frame members to each other at ends thereof to form a generally planar perimeter frame surrounding an open interior for receiving glazing;

the perimeter frame having a front frame surface on a front side of the perimeter frame facing forwardly from a common plane of the perimeter frame, a rear frame surface facing rearwardly from the common plane of the perimeter frame, an inner edge surface facing inwardly into the open interior, and an outer edge surface of the frame members facing outwardly away from the open interior;

providing a frame mounting assembly arranged in said common plane for supporting the perimeter frame having at least one pair of parallel elongate work supports supported for movement relative to one another in said common plane to adjust a spacing therebetween, each work support including at least one clamping surface;

clamping the at least one clamping surfaces against at least a portion of the outer edge surfaces of opposing ones of the elongated frame members forming the perimeter frame;

providing a movable support mechanism supporting a machining device thereon which supports an interchangeable tool head therein;

providing relative movement between the frame mounting assembly and the movable support so as to allow movement of the machining device along substantially a full length of the frame and laterally substantially a full width of the frame and at right angles to the common plane; and machining all required machining operations on the front frame surface, the inner edge surface, the outer edge surface and the rear frame surface of the frame members forming the perimeter frame with the frame supported in one position on the frame mounting assembly.

13. The method according to claim 12 wherein the clamping surfaces of the work supports are substantially narrower than the rear frame surface of the frame members of the frame.

14. The method according to claim 12 including providing each work support with a clamping member arranged to clamp a respective one of the surfaces of the frame and arranging each clamping member for movement relative to the respective work support.

15. The method according to claim 12 wherein the work supports include respective supporting surfaces lying in a generally common plane with one another for supporting the rear frame surface thereon, wherein the supporting surfaces are moveable with the clamping surfaces towards and away from one another.

16. A method of manufacturing a frame for either a door or a window, said method comprising:

providing a plurality of elongated frame members;

joining at least some of the elongated frame members to each other at ends thereof to form a generally planar perimeter frame surrounding an open interior for receiving glazing;

the perimeter frame having a front frame surface on a front side of the perimeter frame facing forwardly from a common plane of the perimeter frame, a rear frame surface facing rearwardly from the common plane of the perimeter frame, an inner edge surface facing inwardly into the open interior, and an outer edge surface of the frame members facing outwardly away from the open interior;

providing a frame mounting assembly arranged in said common plane for supporting the perimeter frame having at least one pair of parallel elongate work supports supported for movement relative to one another in said common plane to adjust a spacing therebetween, each work support including at least one clamping surface;

clamping the at least one clamping surfaces against at least a portion of the outer edge surfaces of opposing ones of the elongated frame members forming the perimeter frame;

providing a movable support mechanism supporting a machining device thereon which supports an interchangeable tool head therein;

providing relative movement between the frame mounting assembly and the movable support so as to allow movement of the machining device along substantially a full length of the frame and laterally substantially a full width of the frame and at right angles to the common plane; and arranging the machining device to machine the front frame surface; the inner edge surface, the outer edge surface and the rear frame surface of the frame members forming the perimeter frame.

17. The method according to claim 16 including machining all required machining operations on the front frame surface, the inner edge surface, the outer edge surface and the rear frame surface of the frame members forming the perimeter frame with the frame supported in one position on the work supports.

18. The method according to claim 16 wherein the clamping surfaces of the work supports are substantially narrower than the rear frame surface of the frame members of the frame.

19. The method according to claim 16 including providing each work support with a clamping member arranged to clamp a respective one of the surfaces of the frame and arranging each clamping member for movement relative to the respective work support.

20. The method according to claim 16 wherein the work supports include respective supporting surfaces lying in a generally common plane with one another for supporting the rear frame surface thereon, wherein the supporting surfaces are moveable with the clamping surfaces towards and away from one another.

* * * * *